US009399214B2

(12) United States Patent
Daub et al.

(10) Patent No.: US 9,399,214 B2
(45) Date of Patent: Jul. 26, 2016

(54) CARTRIDGE, CENTRIFUGE AND METHOD

(75) Inventors: Martina Daub, Weissach (DE); Juergen Steigert, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 1079 days.

(21) Appl. No.: 13/491,022

(22) Filed: Jun. 7, 2012

(65) Prior Publication Data

US 2012/0314532 A1 Dec. 13, 2012

(30) Foreign Application Priority Data

Jun. 7, 2011 (DE) ..... 10 2011 077 115

(51) Int. Cl.

| | |
|---|---|
| ***B01L 3/00*** | (2006.01) |
| ***B01F 9/00*** | (2006.01) |
| ***B01F 11/04*** | (2006.01) |
| ***B01F 13/08*** | (2006.01) |
| ***B01F 15/02*** | (2006.01) |

(52) U.S. Cl.

CPC ..... *B01L 3/5021* (2013.01); *B01F 9/002* (2013.01); *B01F 9/0003* (2013.01); *B01F 11/04* (2013.01); *B01F 13/0854* (2013.01); *B01F 15/0212* (2013.01); *B01F 15/0223* (2013.01); *B01F 15/0233* (2013.01); *B01L 2200/16* (2013.01); *B01L 2300/0672* (2013.01); *B01L 2300/0841* (2013.01); *B01L 2300/1827* (2013.01); *B01L 2400/0409* (2013.01)

(58) Field of Classification Search

CPC ..... B01F 15/00753; B01L 3/5021

USPC ..... 366/209, DIG. 2; 137/797; 506/39

See application file for complete search history.

(56) References Cited

U.S. PATENT DOCUMENTS

2009/0023610 A1* 1/2009 Peytavi ..... B01L 3/5027 506/39

FOREIGN PATENT DOCUMENTS

| | | | |
|---|---|---|---|
| CN | 1627985 | A | 6/2005 |
| CN | 201098645 | Y | 8/2008 |
| CN | 101296753 | A | 10/2008 |
| DE | 10 2006 003 532 | A1 | 7/2007 |
| EP | 2 514 515 | A1 | 10/2012 |
| EP | 2 532 426 | A2 | 12/2012 |
| EP | 2 532 428 | A2 | 12/2012 |
| EP | 2 535 108 | A1 | 12/2012 |
| JP | 2009-222404 | A | 10/2009 |
| WO | 2009/142087 | A1 | 11/2009 |

* cited by examiner

*Primary Examiner* — Tony G Soohoo
*Assistant Examiner* — Anshu Bhatia
(74) *Attorney, Agent, or Firm* — Maginot, Moore & Beck LLP

(57) ABSTRACT

A cartridge includes a first drum having a first chamber and a displacement device that is configured to rotate the first drum about a central axis to connect the first chamber to a second chamber in a conductive manner. The cartridge further includes an electric switch that is configured to be actuated by the displacement device between a closed switching state and an open switching state.

15 Claims, 14 Drawing Sheets

CARTRIDGE, CENTRIFUGE AND METHOD

This application claims priority under 35 U.S.C. §119 to patent application no. DE 10 2011 077 115.8, filed on Jun. 7, 2011 in Germany, the disclosure of which is incorporated herein by reference in its entirety.

BACKGROUND

The performance of biochemical processes is based in particular on the handling of liquids. Typically, this handling is carried out manually using aids such as pipettes, reaction vessels, active probe surfaces and laboratory equipment. These processes are already partially automated using pipette robots or special equipment.

Lab-on-a-chip systems (also referred to as chip lab) accommodate the entire functionality of a macroscopic laboratory on a plastics substrate no larger than the size of a plastics card. Lab-on-a-chip systems are typically made up of two main components. A test carrier contains structures and mechanisms for reacting the fluidic base operations (e.g. mixer), which can comprise passive components, such as channels, reaction chambers and pre-stored reagents, or also active components such as valves or pumps. The second main component comprises actuation, detection and control units. Such systems make it possible to carry out biochemical processes in a fully automated manner.

A lab-on-a-chip system is described for example in document DE 10 2006 003 532 A1. This system comprises a rotor chip which is provided to be rotatable with respect to a stator chip. The rotor chip can be coupled with the stator chip using fluidic channels for filling or emptying the rotor chip.

SUMMARY

The cartridge, the centrifuge, and the method have, with respect to conventional solutions, the advantage that an electric switch can simply be provided and actuated. The switch in turn can be provided for switching a large number of different devices, for example a heater or a sensor or a semiconductor device.

Advantageous configurations of the disclosure can be gathered from the dependent claims.

"Component" in the present case means a liquid, a gas or a particle (or a plurality of particles). The "first and second component" can also merely mean two different states of the same substance: for example, the first component can be formed as a clumped portion and the second component as a liquid portion of the same substance.

According to an embodiment of the cartridge according to the disclosure, the displacement device comprises a first inclined surface which interacts with a second inclined surface of the first drum in order to move the first drum from a first position, in which the second inclined surface is form-fittingly engaged with a housing of the cartridge in the rotational direction about the central axis, into a second position along the central axis and counter to the effect of a restoring means, in which the form fit is cancelled and the first drum rotates about the central axis. This mechanism is also referred to as "ballpoint pen mechanism" in the present case.

According to a further embodiment of the cartridge according to the disclosure, the second chamber and/or a third chamber of the first drum is arranged upstream or downstream with respect to the central axis, wherein preferably the first chamber can be conductively connected selectively with the second chamber or the third chamber using the displacement device.

In addition, the first chamber can preferably be connected selectively with different further chambers, depending on requirements.

According to a further embodiment of the cartridge according to the disclosure, a second drum having the second chamber and/or a third drum, having the third chamber, is provided, wherein preferably the second drum is arranged upstream of the first drum with respect to the central axis and/or the third drum is arranged downstream of the first drum. Thus, a stack of for example three drums can be formed. However, it is also possible for more than three drums to be provided.

According to a further embodiment of the cartridge according to the disclosure, the switch comprises at least a first and a second contact element which contact one another for the closed state of the switch and are spaced apart from each other for the open state of the switch, wherein the first contact element is attached on a front end of the first drum and the second contact element is attached on a front end of the second or third drum which is facing the front end of the first drum, or the first contact element is arranged on the first, second or third drum and the second contact element is arranged on a housing of the cartridge, in particular on a projection thereof. As a result, various switching concepts can be presented: first, the actuation of the switch can depend on the position of the drums with respect to one another, or the actuation of the switch can depend on the position of a drum relative to the housing.

According to a further embodiment of the cartridge according to the disclosure, the switch comprises a plurality of first contact elements, which can be contacted selectively by the second contact element by way of rotating the first drum. As a result, different circuits can be formed. Accordingly it is possible, depending on which first contact element is contacted by the second contact element, for different electrical devices to be supplied with energy or to be actuated.

According to a further embodiment of the cartridge according to the disclosure, the first and second contact elements contact one another in a contact position of the first drum, which follows the second position of the first drum, wherein preferably, in the contact position, the first drum and the housing, in particular projections thereof, engage behind one another in order to avoid self-displacement of the first drum from its contact position into a third position owing to the action of the restoring means. In the contact position of the first drum, the latter is rotated with respect to the second drum, but has also moved toward the second drum again in comparison to the second position. Owing to this approaching movement, the first and second contact elements are contacted, i.e. the switch is closed.

According to a further embodiment of the cartridge according to the disclosure, the first and/or second contact element comprises at least one conductor track at least sectionally and, if appropriate, at least one metallic bump. Such contact elements are easily producible.

According to a further embodiment of the cartridge according to the disclosure, the switch can be connected to a read device, which is configured to read a switching state of the switch and, if appropriate, to store a switching profile of the switch. As a result, the operations in the cartridge can be simply monitored, for example for quality assurance purposes.

According to a further embodiment of the cartridge according to the disclosure, this cartridge has a heating device, provided in particular in or on a housing of the cartridge for the first, second and/or third drum, for in particular cyclic heating of the first, second and/or third chamber, which heating device is switchable by way of actuating the electric switch for heating. As a result, the heating device can provide for example the necessary temperature profile in the first chamber such that a polymerase chain reaction can occur in a component in the first chamber.

According to a further embodiment of the cartridge according to the disclosure, this cartridge furthermore has a semiconductor device, provided in particular in or on a housing of the cartridge for the first, second and/or third drum, which semiconductor device is actuatable by actuating the electric switch. The semiconductor element can be for example a temperature sensor, which is supplied with energy by the switch for carrying out a temperature measurement.

According to a further embodiment of the cartridge according to the disclosure, this cartridge is configured for being placed in a centrifuge and for centrifugation thereof, and the displacement device is configured to actuate the first drum for rotation about the central axis when the centrifugal force exceeds a predetermined threshold value, and/or the displacement device has an actuator which directly or indirectly actuates the first drum for rotation about the central axis. There are accordingly several possibilities for rotating the first drum, which can also be provided in combination with one another. The force which moves the components, that is for example liquids, through the cartridge can be provided as centrifugal force. If the cartridge with the actuator is stationary, however, a pressure device is suitable, which generates an appropriate pressure, in particular gas or liquid pressure, which moves the components through the cartridge.

According to a further embodiment of the cartridge according to the disclosure, the switch is connected to an energy source by way of wires or is connectable in wireless fashion in order to generate a flow of energy, in the closed state of the switch, through said switch. Wireless solutions can make use of coils or a battery in the cartridge.

BRIEF DESCRIPTION OF THE DRAWINGS

Exemplary embodiments of the disclosure are illustrated in the figures of the drawing and are explained in detail in the following description.

In the figures.

DETAILED DESCRIPTION

In the figures, identical reference signs designate identical or functionally identical elements, unless the contrary is stated.

Figure 1:
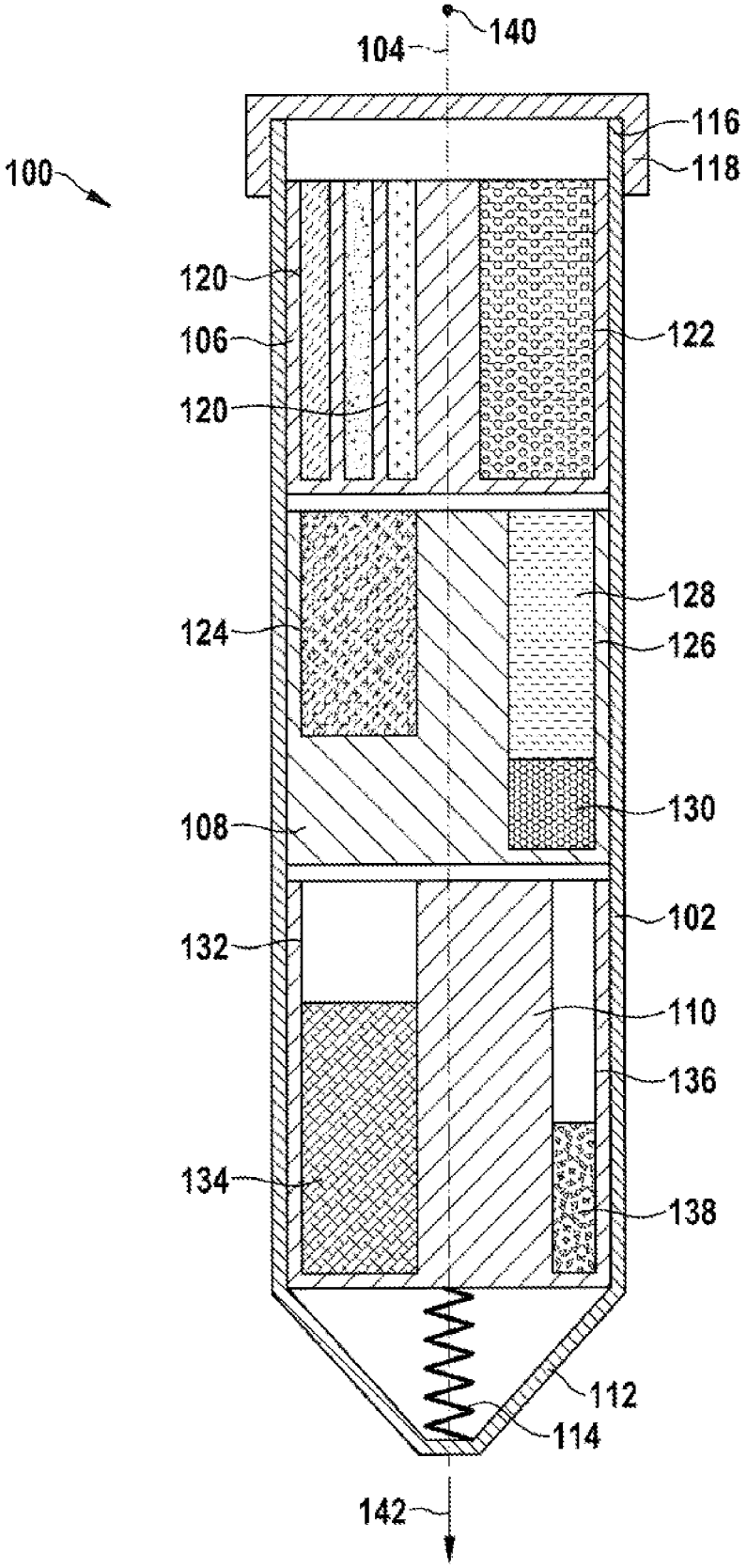
FIG. 1 schematically shows a section through a cartridge according to an exemplary embodiment of the present disclosure.

FIG. 1 shows, in a sectional view, a cartridge 100 according to an exemplary embodiment of the present disclosure.

The cartridge 100 comprises a housing 102 in the form of a tube. For example, the housing 102 can be configured as a 5 to 100 mL, in particular 50 mL, centrifuge tube, 1.5 mL or 2 mL Eppendorf tube or alternatively as a microtiter plate (e.g. 20 μL per cavity). The longitudinal axis of the housing 102 is designated 104.

Received in the housing 102, for example, are a first drum 108, a second drum 106 and a third drum 110. The drums 106, 108, 110 are arranged one behind the other and in terms of their respective central axes coaxially with the longitudinal axis 104.

The housing 102 is configured closed at its one end 112. Arranged between the closed end 112 and the third drum 110, which is arranged adjacent thereto, is a restoring means for example in the form of a spring 114. The spring 114 can be configured in the form of a coil spring or of a polymer, in particular an elastomer. The other end 116 of the housing 102 is closed by means of a closure 118. The closure 118 can preferably be taken off in order to remove the drums 106, 108, 110 from the housing 102. Alternatively, it is also possible for the housing 102 itself to be capable of being disassembled in order to remove the drums 106, 108, 110 or to access the chambers, for example the chamber 136.

According to a further exemplary embodiment, the spring 114 is arranged between the closure 118 and the second drum 106 so that the spring 114 is stretched for generating a restoring force. Other arrangements of the spring 114 are also conceivable.

A respective drum 106, 108, 110 can have one or more chambers:

For example, the second drum 106 comprises a plurality of chambers 120 for reagents and a further chamber 122 for holding a sample, for example a blood sample which was taken from a patient.

The first drum 108, which is connected downstream of the second drum 106, comprises a mixing chamber 124 in which the reagents from the chambers 120 are mixed with the sample from the chamber 122. In addition, the drum 108 comprises for example a further chamber 126, in which the mixture 128 flows from the mixing chamber 124 through a solid phase 130. The solid phase 130 can be a gel column, a silica matrix or a filter.

The third drum 110, which is again connected downstream of the first drum 108, comprises a chamber 132 for receiving a waste product 134 from the chamber 126. Furthermore, the drum 110 comprises a further chamber 136 for receiving the desired end product 138.

The cartridge 100 has an external geometry such that it can be placed in a holder of a rotor of a centrifuge, in particular in a holder of a swing-out rotor or a fixed-angle rotor of a centrifuge. During centrifugation, the cartridge 100 is rotated at a high rotational speed about a center of rotation 140 which is indicated schematically in FIG. 1. The center of rotation 140 is located in this case on the longitudinal axis 104 so that a corresponding centrifugal force 142 acts on each structural part of the cartridge 100 along the longitudinal axis 104.

It is now the aim that, using a suitable control of the rotational speed, different processes within the cartridge 100 are controlled. For example, the mixing chamber 124 is intended to be connected fluidically first with the chamber 122 in order to receive the sample from the chamber 122. Hereafter, the mixing chamber 124 is intended to be connected to the chambers 120 in order to receive the reagents therefrom. Subsequently the reagents and the sample are intended to be mixed in the mixing chamber 124 in a manner such that the rotational speed is controlled. Similarly, the processes in the chambers 126, 132 and 136 are also intended to be controlled in terms of rotational speed.

The FIGS. 2A-2G perspectively show different structural parts of the cartridge 100 from FIG. 1. With reference to FIGS. 2A-2G, the intention is in particular for a displacement device 300 (see FIG. 3A) to be explained below, which displacement device makes possible the rotational-speed-dependent control of the previously mentioned processes.

Figure 2A:
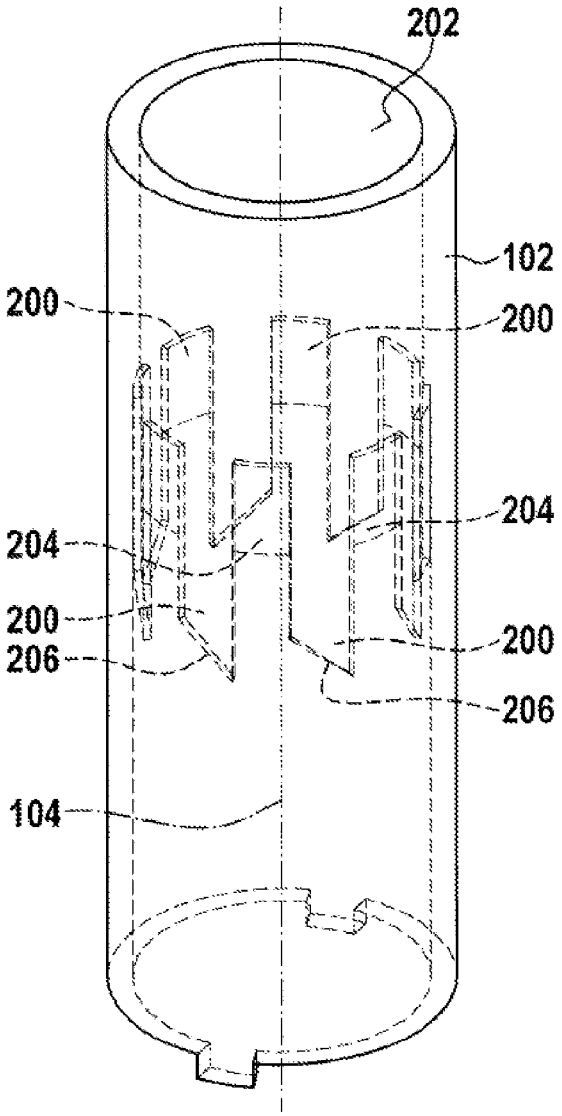
FIGS. 2A-2G show perspective views of different structural parts of the cartridge from FIG. 1.

As shown in FIG. 2A, the housing 102 has on its inside projections 200. The projections 200 protrude radially toward the longitudinal axis 104 from the housing inner wall 202. Formed between the projections 200 are slots 204, which extend along the longitudinal axis 104. The projections 200 are in each case on their one end formed by an inclined surface 206. The inclined surfaces 206 point away from the center of rotation 140 during operation of the centrifuge with the cartridge 100.

Figure 2B:
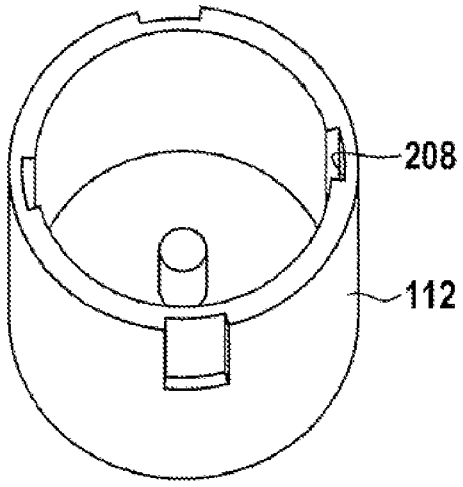

FIG. 2B shows the end 112 of the housing 102, which according to this exemplary embodiment is configured as a removable cap. The end 112 has at its internal circumference a plurality of grooves 208 which extend along the longitudinal axis 104.

Figure 2C:
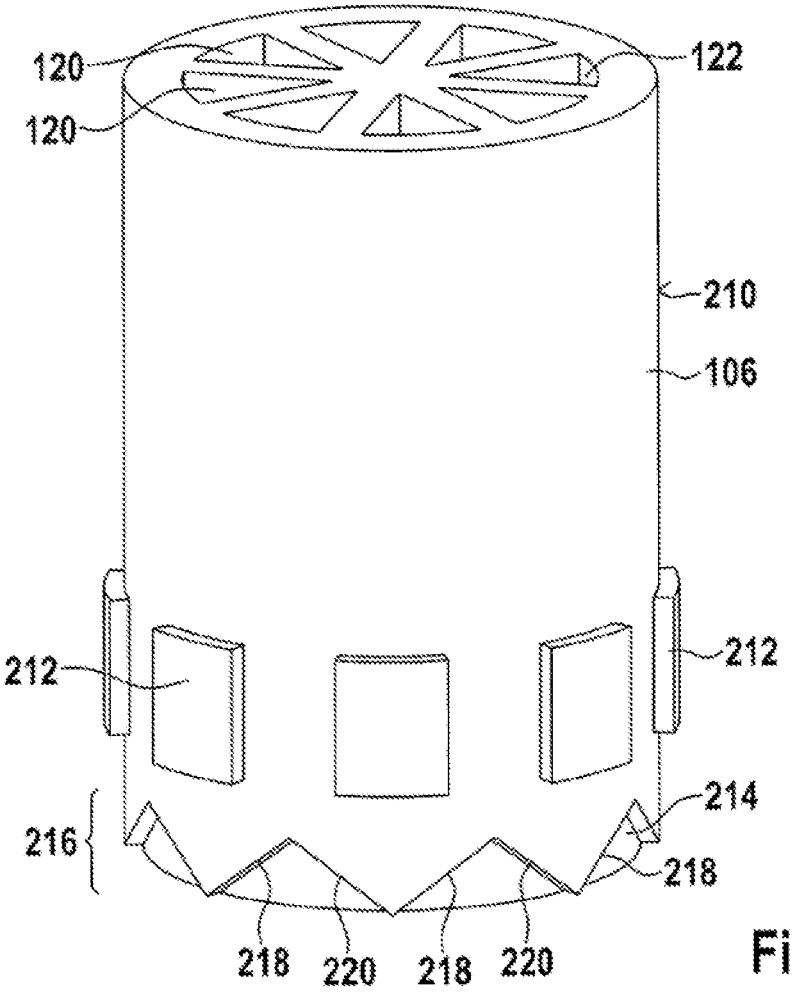

FIG. 2C shows the second drum 106 with the chambers 120, 122. The drum 106 has on its external wall 210 a plurality of projections 212 which extend radially outward from the external wall 210. In the assembled state of the cartridge 100, the projections 212 of the drum 106 engage in the slots 204 of the housing 102. As a result, rotation of the drum 106 about the longitudinal axis 104 is locked. The drum 106, however, is movable in the slots 204 along the longitudinal axis 104. The second drum 106 has furthermore on its external wall 210, in particular on its end 214 facing the first drum 108, a crown-type contour 216, comprising a multiplicity of inclined surfaces 218, 220. Two inclined surfaces 218, 220 in each case form a pointed prong of the crown-type contour 216. The inclined surfaces 218, 220 likewise point away from the center of rotation 140 during operation of the centrifuge with the cartridge 100.

Figure 2D:
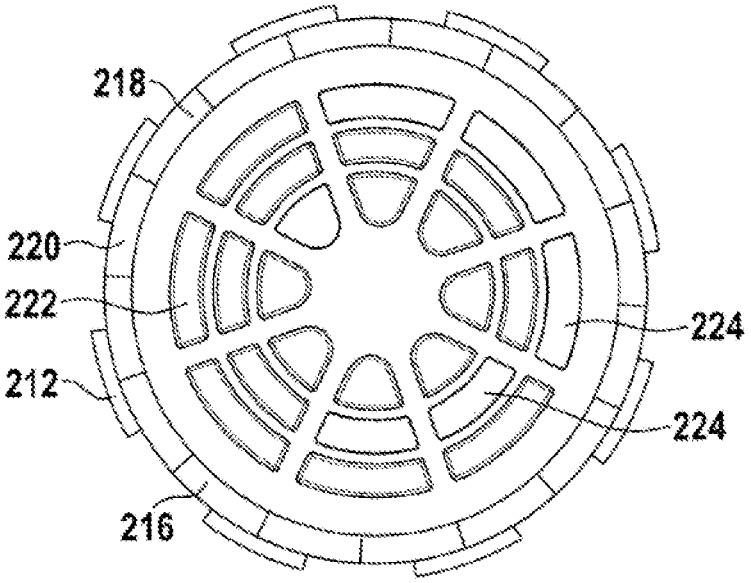

FIG. 2D shows a view of the second drum 106 from FIG. 2C from below. The underside 222 of the drum 106, which is associated with the end 214, has a plurality of openings 224 in order to connect the chambers 120, 122 to the mixing chamber 124 of the first drum 108 in a liquid-, gas- and/or particle-conducting manner ("conducting/conductively" below). Alternatively or additionally, the openings 224 can also conductively connect the chambers 120, 122 to the chamber 126 of the first drum 108. A respective conducting connection is determined according to the position of a respective opening 224 with respect to the chambers 124, 126. This position is attained by rotating the first drum 108 with respect to the second drum 106, as will be explained in more detail at a later point.

Figure 2E:
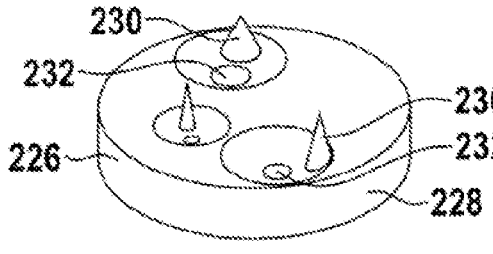

FIG. 2E shows a lancet device 226 which is not shown in FIG. 1. The lancet device 226 comprises a plate 228 with one or a plurality of mandrels 230, which are arranged in each case adjacently to an opening 232 in the plate 228. The mandrels 230 serve for penetrating, in a rotational-speed-controlled manner, a respective opening 224 in the underside 222 of the second drum 106, as a result of which in particular liquid flows from the corresponding chamber 120, 122 through the opening 232 into the chambers 124 or 126.

Figure 2F:
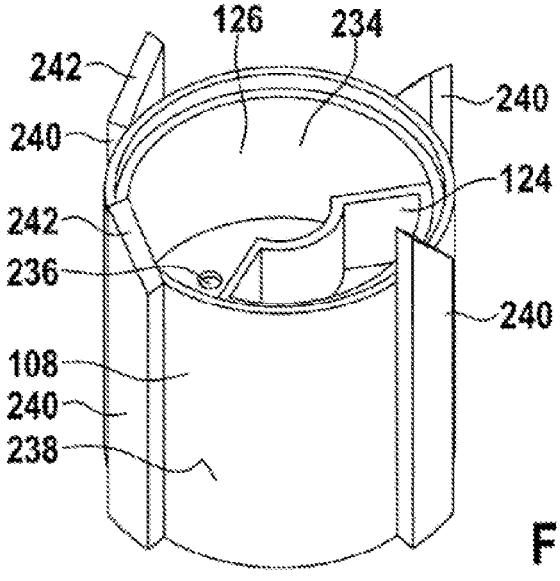

FIG. 2F shows the first drum 108 with the chambers 124, 126. At the bottom 234 of the chamber 126, for example, an opening 236 for a conducting connection between the chamber 126 and the chambers 132, 136 of the third drum 110 is provided. The first drum 108 has at its external wall 238 a plurality of projections 240. The projections 240 are configured to engage in the slots 204 (just like the projections 212 of the second drum 106). As long as the projections 240 are in engagement with the slots 240, rotation of the first drum 108 about the longitudinal axis 104 is locked. However, the projections 240 together with the first drum 108 are movable in the slots 204 along the longitudinal axis 104. The projections 240 have inclined surfaces 242 which point toward the center of rotation 140 during operation of the centrifuge with the cartridge 100 and are formed to correspond to the inclined surfaces 206 and 220.

Figure 2G:
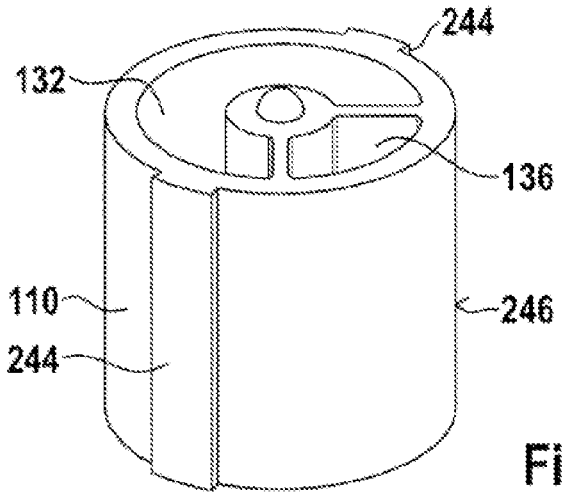

FIG. 2G shows the third drum 110 with the chambers 132, 136. The drum 110 has projections 244 which respectively protrude from the external wall 246 of the drum 110. The projections 244 are configured to engage in the grooves 208 of the end 112 such that the drum 110 is movable in the grooves 208 in the longitudinal direction 104. Rotation of the drum 110 about the longitudinal axis 104, however, is thus locked.

Figure 3A:
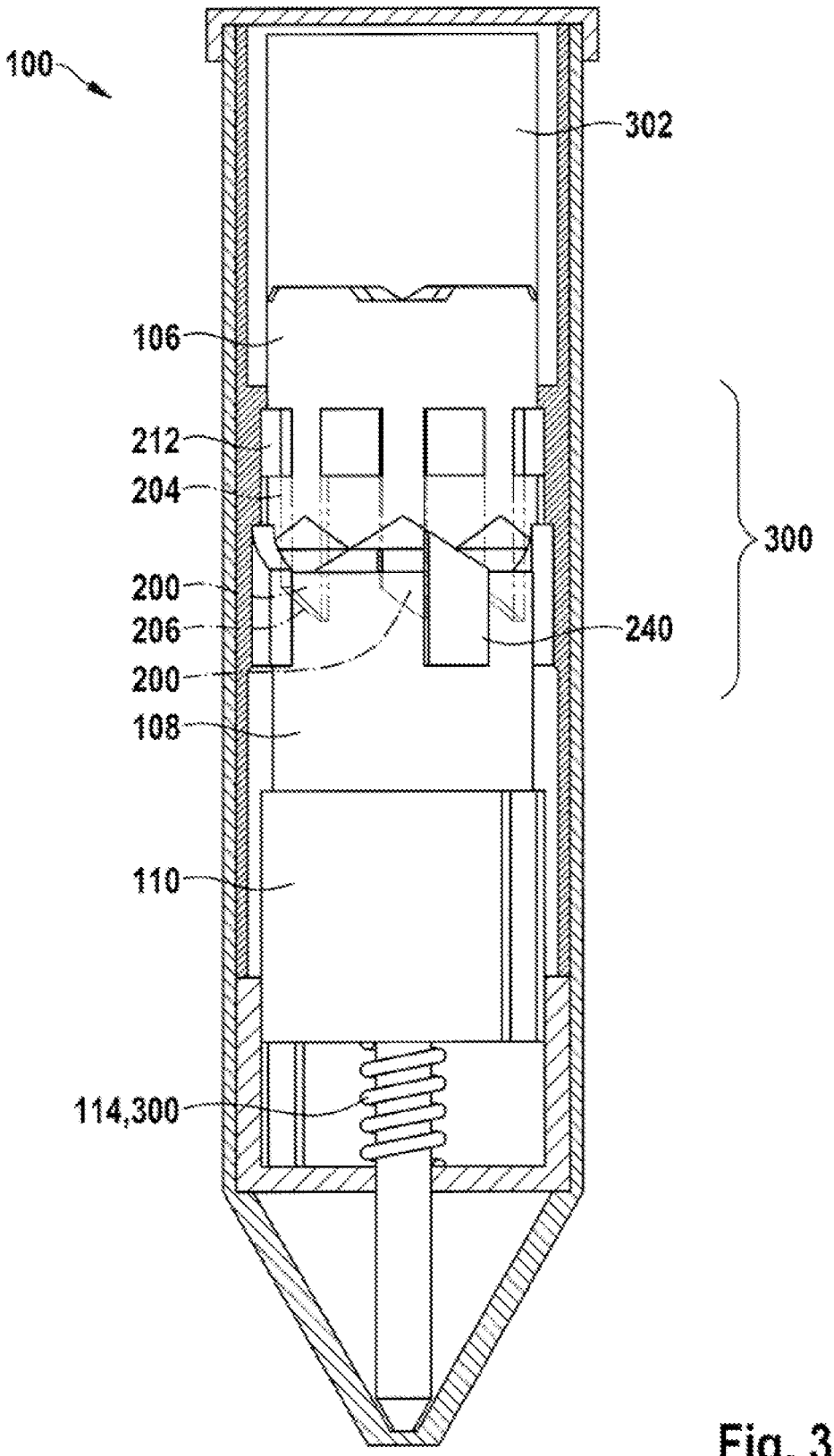
FIGS. 3A-3E show different operating states of the cartridge from FIG. 1.
Figure 3B:
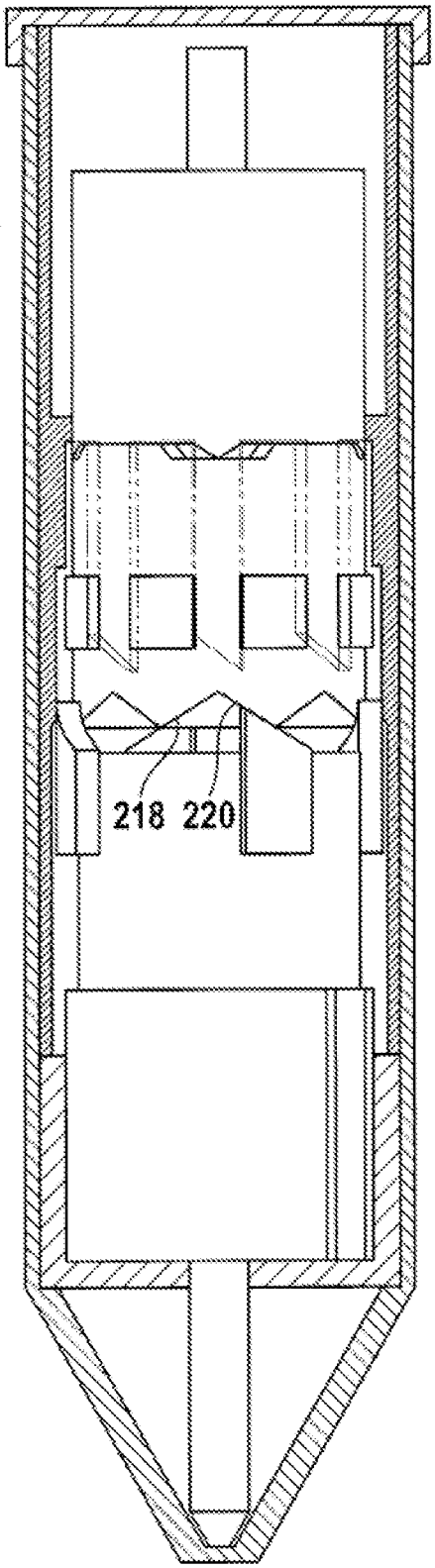
Figure 3C:
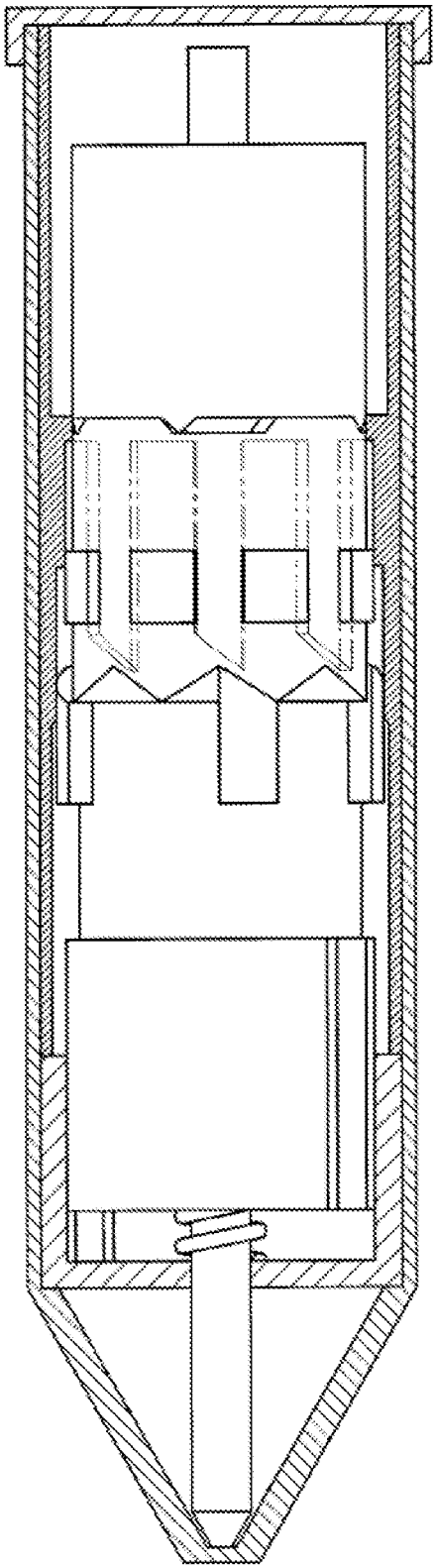
Figure 3D:
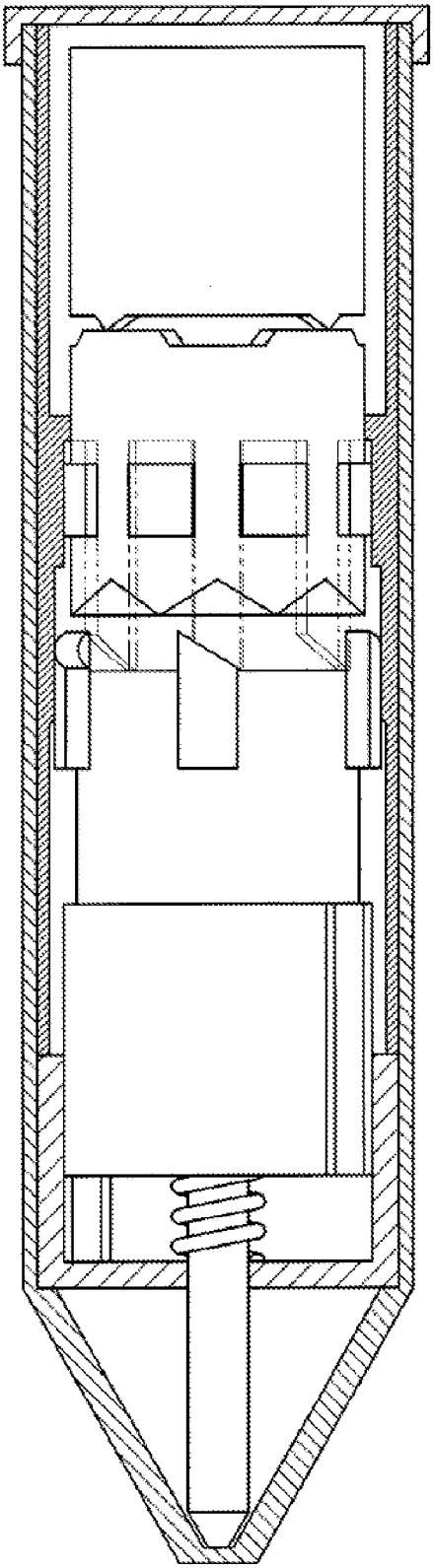
Figure 3E:
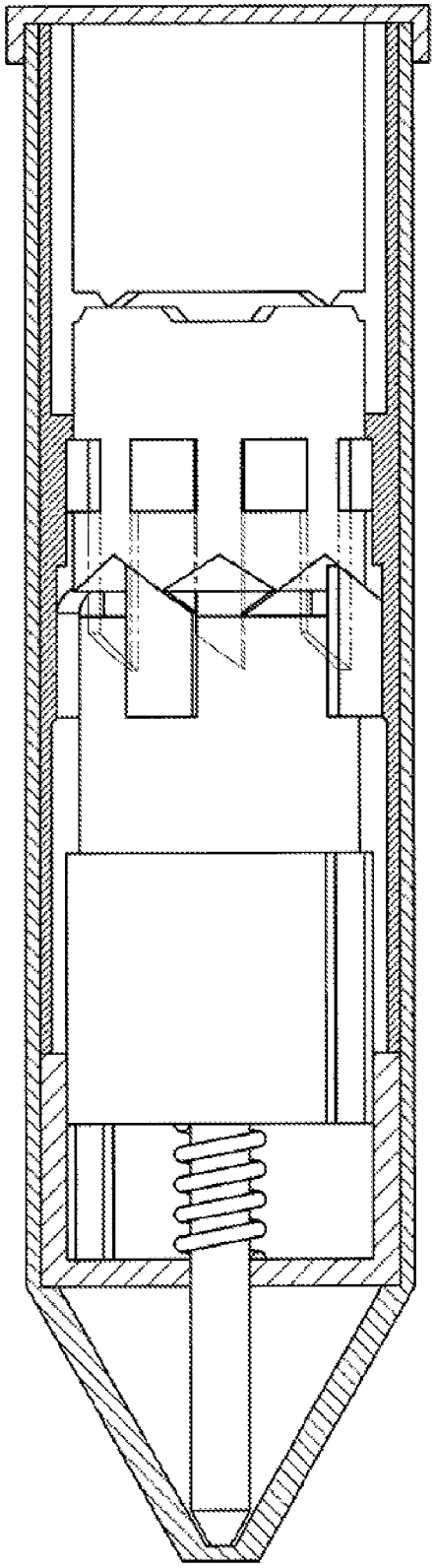

FIGS. 3A-3E show several operating states during operation of the cartridge 100 from FIG. 1, wherein an additional drum 302 is shown, which, however, is of no further relevance in the present case. FIGS. 4A-4E in each case correspond to FIGS. 3A-3E and illustrate the movement of the inclined surfaces 206, 218, 220, 242 relative to one another. For supplementary purposes it is however noted that FIG. 3B shows an operating state of the cartridge 100, which is more advanced than the state shown in FIG. 4B. In the FIGS. 3A-3E, the housing 102 is shown to be partially transparent so as to offer a view of the inside.

The projections 200, the slots 204, the inclined surfaces 206, the projections 212, the inclined surfaces 218, 220, the projections 240 and the inclined surfaces 242 form, in cooperation with the restoring spring 114, the abovementioned displacement device 300 for defined rotation of the first drum 108 with respect to the other drums 106, 110 about the longitudinal axis 104.

Figure 4A:
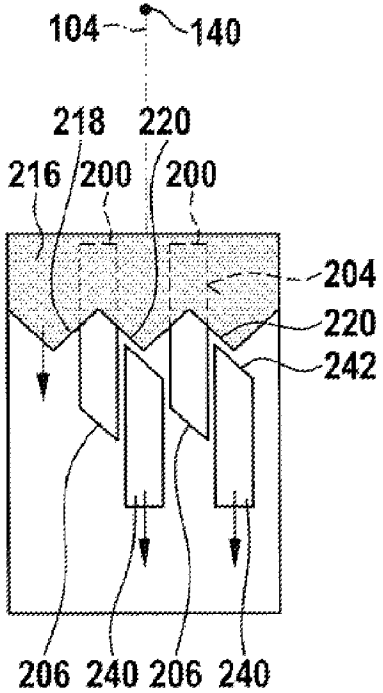
FIGS. 4A-4E show detailed views of a displacement device according to the different operating states from FIGS. 3A-3E.
Figure 4B:
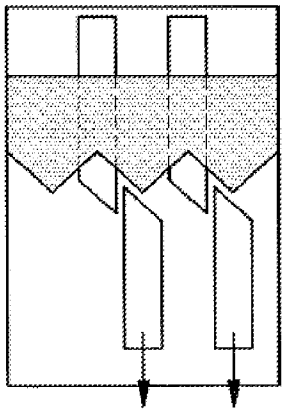
Figure 4C:
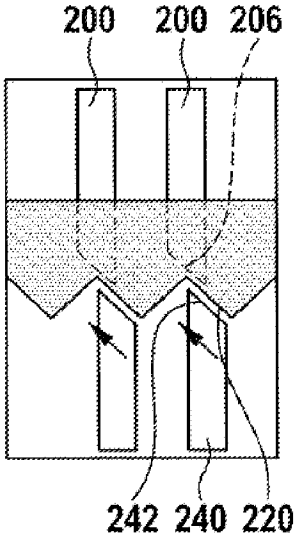

FIGS. 3A and 4A show a first position, in which the projections 240 of the first drum 108 engage in the slots 204 and thus rotation of the drum 108 about the longitudinal axis 104 is locked. If the rotational speed of the centrifuge is now increased, the second drum 106 pushes by way of the inclined surfaces 220 of the contour 216 against the inclined surfaces 242 of the first drum 108 counter to the action of the spring 114, and in doing so the spring 114 is compressed. As a result, the drum 108 moves in a direction away from the center of rotation 140, as is indicated by the corresponding arrows in FIGS. 4A and 4B. This movement is continued until the projections 240 become disengaged from the projections 200. In this second position, rotation of the drum 108 about the longitudinal axis 104 is made possible, as illustrated in FIG. 4C. As a result of the interaction between the inclined surfaces 220 and 242, which are aligned for example in each case at an angle of 45° with respect to the longitudinal axis 104, a force component results which automatically rotates the drum 108 when the latter assumes the second position, as is indicated by arrows that point to the left in FIG. 4C.

Figure 4D:
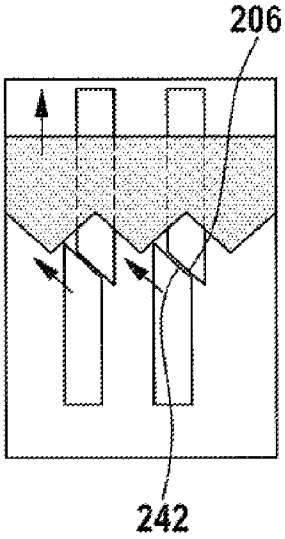
Figure 4E:
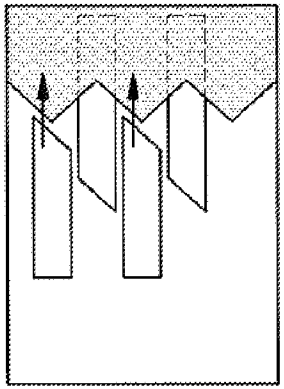

If the rotational speed is then reduced again, which is accompanied by a corresponding reduction in the centrifugal force, the spring 114 pushes the first drum 108, by way of the third drum 110, again in the direction of the center of rotation 140. As a result, the second drum 106 together with its inclined surfaces 220 is likewise moved again in the direction of the center of rotation 140, as a result of which the inclined surfaces 242 of the first drum 108 come to bear against the inclined surfaces 206 of the housing 102 and slide along them while performing another rotation of the drum 108 into a third position, as is illustrated in FIGS. 4D and 4E. In the third position, the projections 240 of the drum 108 are once again arranged in the slots 204 of the housing 102, and further rotation of the drum 108 about the longitudinal axis 104 is thus locked again.

The process described above can be repeated as often as desired in order to rotate the first drum 108 in a defined manner relative to the other drums 106 and 110.

The cartridge 100 furthermore has an electric switch 500. This switch is partially shown in FIG. 5, which shows schematically in a perspective view as seen at an angle from above the first drum 108 from FIG. 2F. For the sake of a simpler illustration, the drum 108 is shown without the inclined surfaces 242 and other details from FIG. 2F. The switch 500 is shown in its entirety in FIGS. 6A to 6B, which schematically show different switching states of the switch 500 according to an exemplary embodiment of the cartridge 100 according to the disclosure. Of the cartridge 100, however, only the second drum 106 and the first drum 108 are shown in each case.

Figure 5:
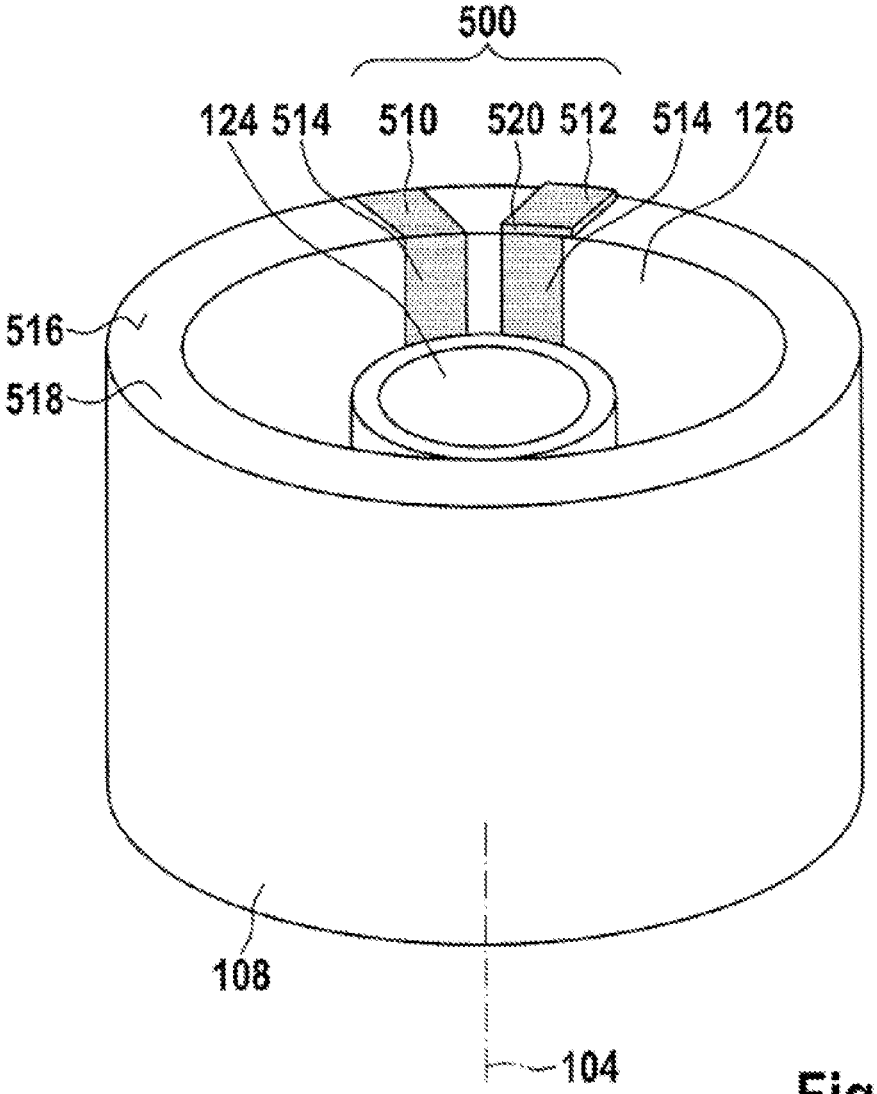
FIG. 5 shows schematically in a perspective view seen at an angle from above the drum from FIG. 2F.
Figures 6A, 6B, 6C, 6D:
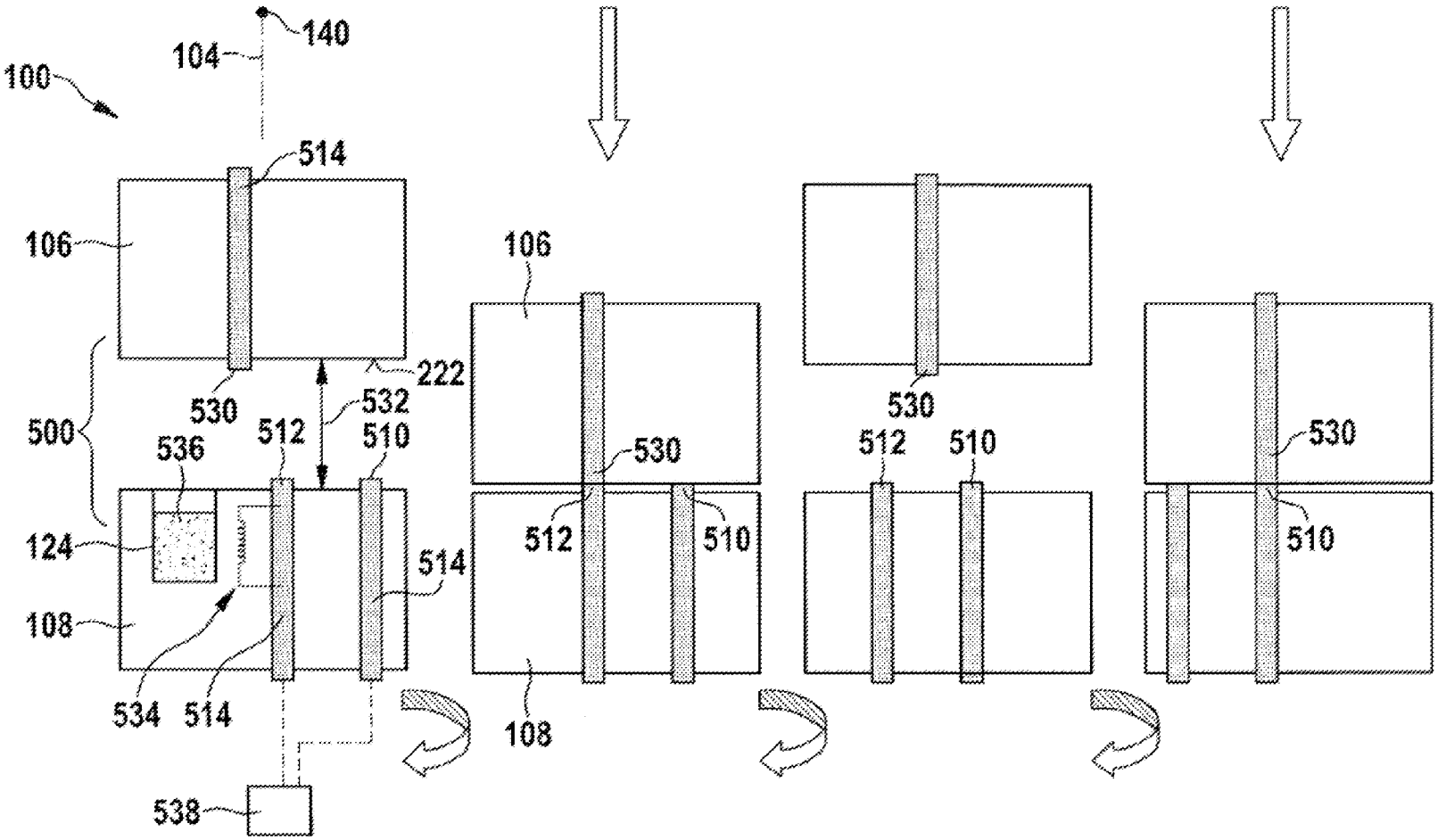
FIGS. 6A-6D schematically show different switching states of a switch of the cartridge from FIG. 1.

As shown in FIG. 5, the switch 500 can have first contact elements 510, 512. The contact elements 510, 512 are formed, according to the exemplary embodiment, in each case as a section of a respectively associated conductor track 514. The conductor tracks 514 extend, for example, in each case sectionally along the central axis 104 on the drum wall 518, i.e. for example along an internal side of the chamber 126, and sectionally along the front end 516 of the drum wall 518. FIG. 6A shows that the conductor tracks 514 can also extend along an external side of the drum wall 518. A respective front-end section of a conductor track 514 forms the contact elements 510 and 512, respectively. As is shown by way of example for the contact element 512, it can additionally comprise an elevated area 520 ("bump"), for example made of gold, which further improves the contact with a second contact element 530, see FIG. 6A.

The conductor tracks 514 are applied on the surface of the drum wall 518 at least sectionally for example using vapor deposition, galvanization, plasma-coating or printing. Furthermore, the conductor tracks 514 can be patterned using etching processes or laser ablation. Furthermore, the conductor tracks 514 can be adhesively bonded or laminated onto the surface directly or via a film. The conductor tracks 514 can furthermore also be concomitantly molded during the manufacturing process of the first drum 108 for example by injection molding. The conductor tracks 514 can also be coated with a protective layer. The conductor tracks 514 typically have a thickness of a few nanometers (e.g. 50 nm) up to several millimeters (e.g. 3 mm) or can also be configured as wires. The width of the conductor tracks 514 can vary from a few micrometers to several millimeters. The conductor tracks 514 can have metallic materials such as copper, gold, aluminum, platinum, titanium, the alloys thereof or doped semiconductor materials such as silicon.

The second contact element 530 is arranged on the front end (corresponds to the underside 222, see FIG. 2D) of the second drum 106 and can therefore likewise be formed sectionally as a conductor track 514. The aforementioned statements relating to the contact elements 510, 512 and conductor tracks 514 apply accordingly.

If the first drum 108 is now displaced using the displacement device 300 ("actuation of the ballpoint pen mechanism"), the first contact element 512 or the first drum 108 initially still has a spacing 532 with respect to the second contact element 530 or the second drum 106. This corresponds to the first position of the first drum 108, see FIG. 4A. If the rotational speed of the centrifuge is now increased, the first drum 108 assumes its second position (as described above in connection with FIG. 4A). Following the second position, the first and the second drum 108, 106 and thus the first and second contact elements 512, 530 move toward each other, see FIG. 4C. The first drum 108 rotates at the same time. The contact elements 512, 530 thus assume a contact position in which they are in electrical contact with one another, see FIG. 6B. An electric circuit is closed as a result. As a result, current flows through a heating device 534, for example, which is provided adjacently to the chamber 124 in the first drum 108, and thus a component 536 in the chamber 124 is heated. For example, for carrying out a PCR (polymerase chain reaction) the temperatures must cyclically be matched from about 94° C. to about 54° C. and about 72° C. in the component 536, for which purpose the heating device 534 can be used. The component 536 can, for example, have been transferred from the chamber 120 of the second drum 106 into the chamber 124 in a preceding step, as described above. Alternatively, the chambers 120, 124 can also simultaneously be conductively connected to each other for transferring the component 536 and heated.

Instead of the heating device 534, it is also possible for any other desired electrical device to be switched using the switch 500. Particularly suitable here are metallic structural parts (in multilayer structure or in the form of alloys) and/or semiconductor elements, for example CMOS, electrodes or sensors, for example ChemFETs. These can be arranged in the drums 106, 108, 110 or in the housing 102. The abovementioned statements relating to the conductor tracks 514 apply correspondingly. Thus electrodes for example can be produced using vapor deposition on the first drum 108.

For example, the switch can be connected with a read device 538 in the form of a microchip (semiconductor element) 538. The read device 538 registers at what times the switch 500 is closed. The read device 538 can store the corresponding switching profile. The switching profile in turn can be read from the read device 538 in particular without wires for example for quality assurance purposes.

Using the displacement device, i.e. using a suitable control of the rotational speed of the centrifuge, the drums 106, 108 and the contact elements 512, 530 move from the contact position into the aforementioned third position, see FIGS. 4E and 6C. In the process, the first drum 108 is again moved a little further, see FIG. 4D. In the third position, the drums 106, 108 and the contact elements 512, 530 are again mutually spaced apart.

If the rotational speed is then increased again, the aforementioned process repeats, except this time the other first contact element 510 comes into contact with the second contact element 530, see FIG. 6D. As a result, another process can then be triggered, for example activation of a pump.

It is also possible for a plurality of second contact elements 530 to be provided.

Figure 7B:
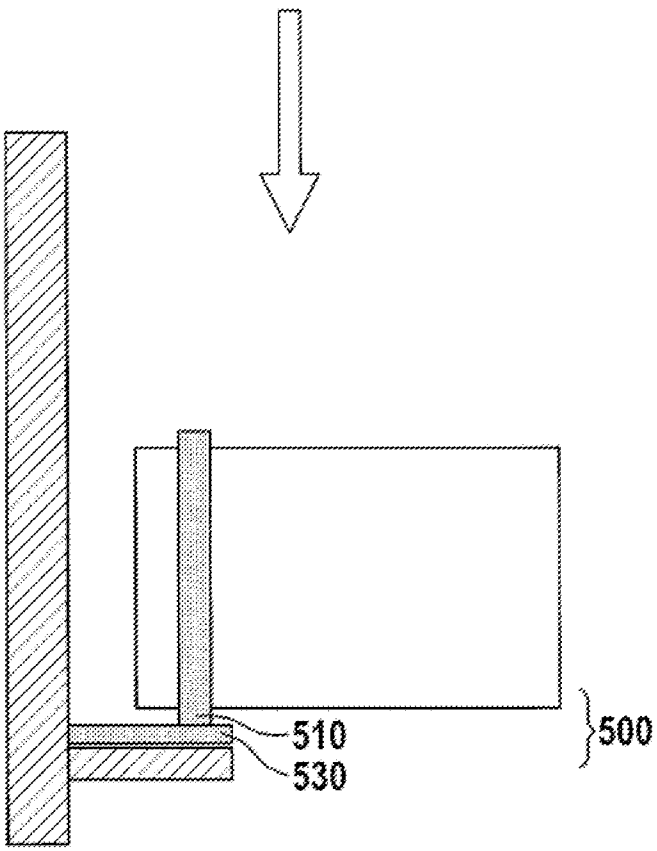
FIGS. 7A and 7B schematically show different switching states of a switch of a cartridge according to a further exemplary embodiment of the disclosure.
Figure 7A:
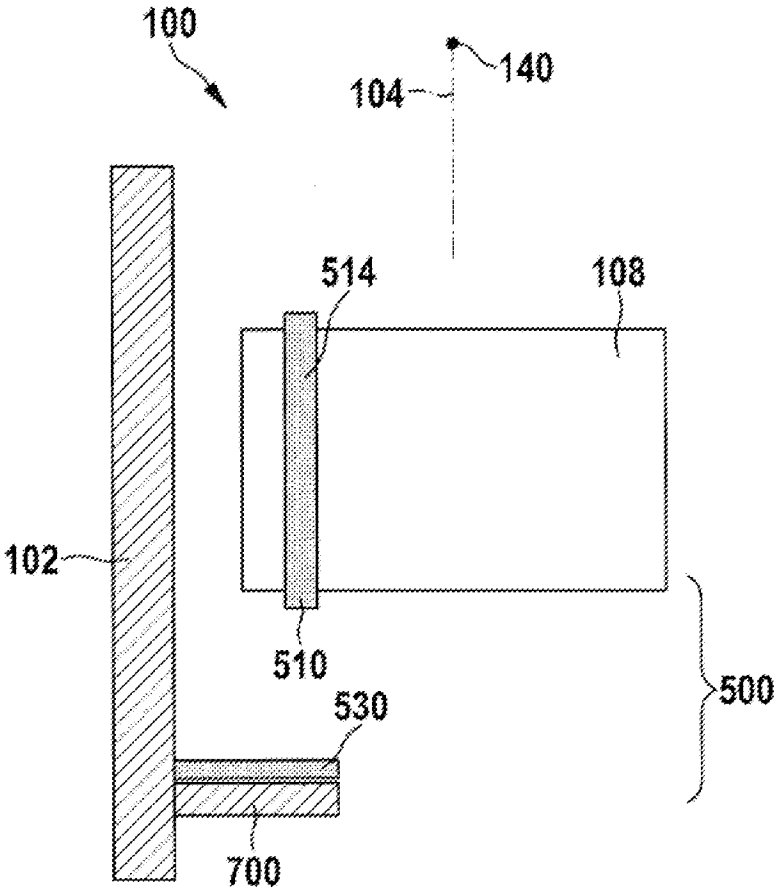

FIGS. 7A and 7B schematically show various switching states of a switch 500 of a cartridge 100 according to a further exemplary embodiment of the disclosure.

The first contact element 510 is provided on a front end of the first drum 108 which points away from the center of rotation 140. The second contact element 530 is applied on a projection 700, which extends from the housing 102. The second contact element 530 points in the direction of the center of rotation 140.

FIG. 7A shows the first position of the first drum 108, see also FIG. 4A, in which the contact elements 510, 530 are mutually spaced apart and thus open. FIG. 7B shows the contact position of the contacts 510, 530, that is to say the closed switching state of the switch 500, see also FIG. 4C. Actuation of the first drum 108 from the first position into the contact position takes place in a rotation-speed-controlled manner.

Figure 8A:
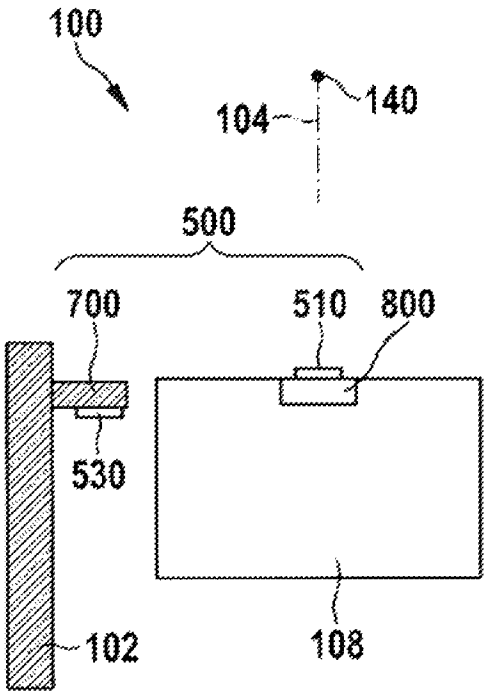
FIGS. 8A-8C schematically show different switching states of a switch of a cartridge according to yet another exemplary embodiment of the disclosure.
Figure 8B:
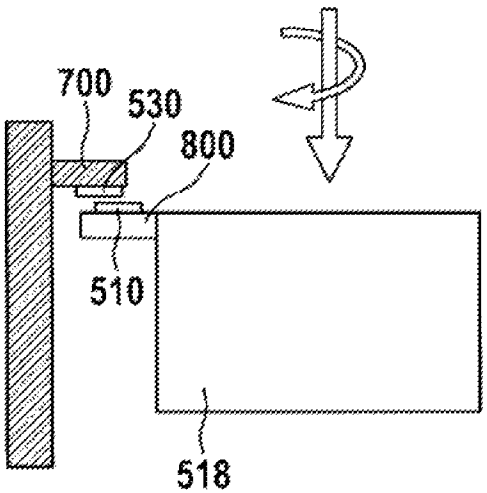

FIGS. 8A and 8B schematically show various switching states of a switch 500 of a cartridge 100 according to yet another exemplary embodiment of the disclosure.

The first drum 108 comprises a tab 800, which extends radially outwardly with respect to the central axis 104 from the drum wall 518. The first contact element 510 is arranged on the tab 800 and points in the direction of the center of rotation 140. The second contact element 530 is provided on a tab 700 of the housing 102 and points in a direction away from the center of rotation 140.

Figure 8C:
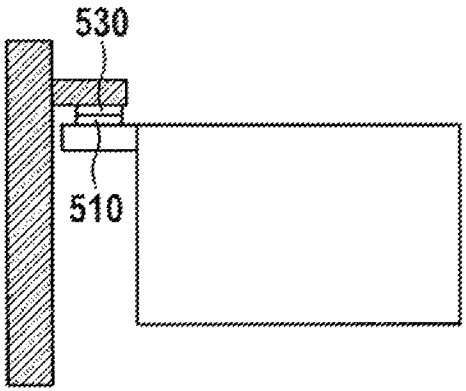

The displacement device 300 is used to bring the contact elements 510, 530 into contact with each other, wherein the first drum 108 moves in a direction away from the center of rotation 140 along the longitudinal axis 104 and is subsequently rotated, see FIGS. 8B, 4B and 4C, as a result of which the contact element 510 ends up underneath the contact element 530. At the same time as the rotation, the drum 108, however, moves again in the direction of the center of rotation 140, see FIG. 4C. As a result, the contacts 510, 530 are brought into contact with each other, see FIG. 8C. In the contact position, the tab 800 engages behind the tab 700 such that—owing to the action of the spring 114—the contact elements 510, 530 remain in contact even if the rotational speed is reduced. Only when the rotational speed is increased again does the contact element 510 lift off from the contact element 530 again and the tab 800 rotates further, as a result of which the tabs 700, 800 disengage.

Figure 9:
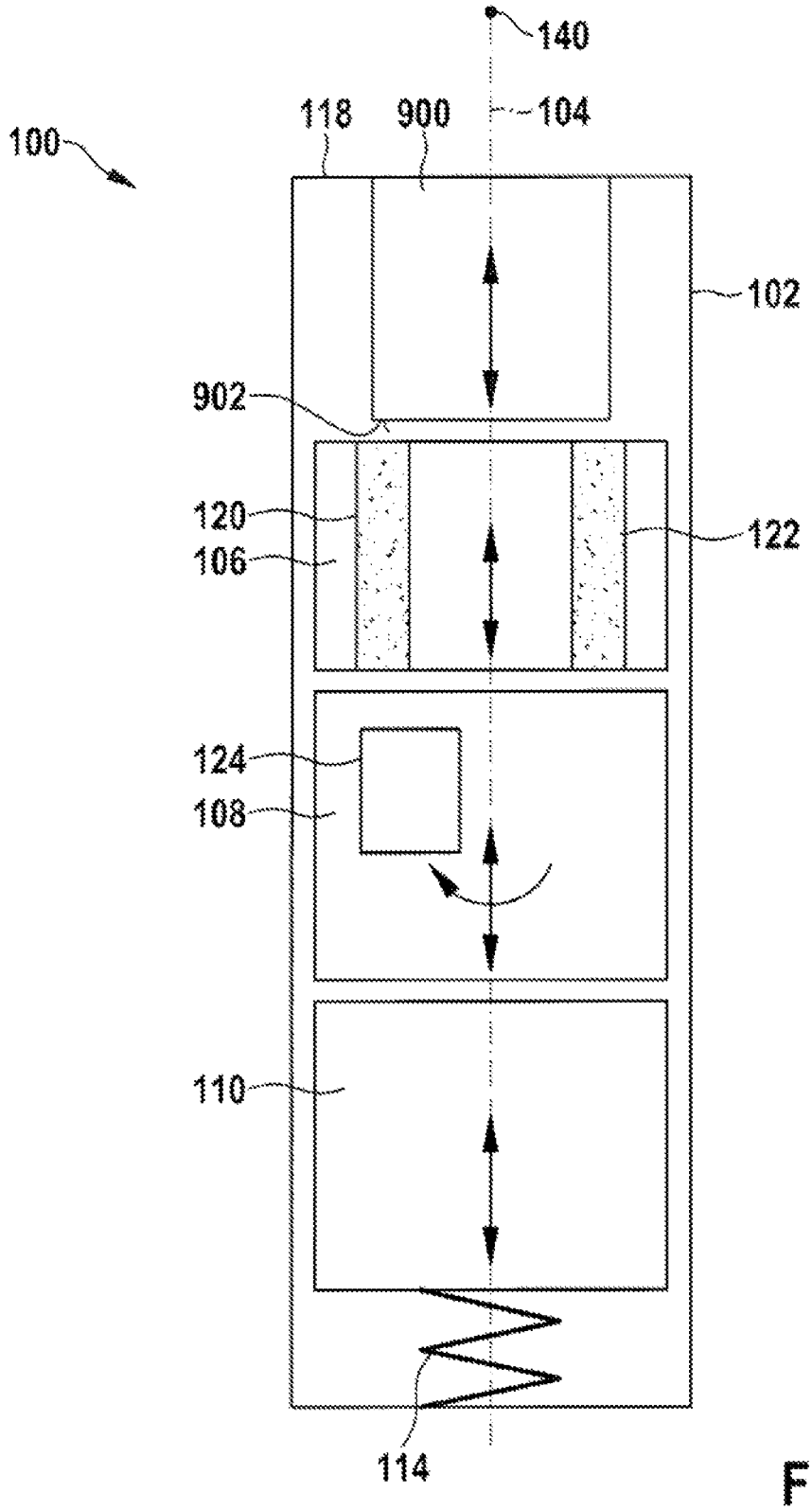
FIG. 9 schematically shows a section through a cartridge according to yet another exemplary embodiment of the present disclosure.

FIG. 9 illustrates that it is possible to provide an actuator 900, which provides for the rotational movement of the first drum 108, rather than or additionally to the centrifugal force 142.

The actuator 900, the projections 200, the slots 204, the inclined surfaces 206, the projections 212, the inclined surfaces 218, 220, the projections 240 and the inclined surfaces 242 form, in cooperation with the restoring spring 114, in the present exemplary embodiment, the aforementioned displacement device 300 for defined rotation of the first drum 108 with respect to the other drums 106, 110 about the longitudinal axis 104.

If the actuator 900 pushes indirectly or directly, for example by its front end 902, against the second drum 106, the drum 106 in turn pushes by way of the inclined surfaces 220 of the contour 216, see FIG. 4A, against the inclined surfaces 242 of the drum 108 counter to the action of the spring 114, thus compressing the spring 114. As a result, the drum 108 moves in a direction away from the center of rotation 140, as is indicated by the corresponding arrows in FIGS. 4A and 4B. This movement is continued until the projections 240 become disengaged from the projections 200. In this second position, rotation of the drum 108 about the longitudinal axis 104 is made possible, as illustrated in FIG. 4C. As a result of the interaction between the inclined surfaces 220 and 242, which are aligned for example in each case at an angle of 45° with respect to the longitudinal axis 104, a force component results which automatically rotates the drum 108 when the latter assumes the second position, as is indicated by arrows that point to the left in FIG. 4C.

If the actuator 900 now releases the second drum 106, the spring 114 pushes the first drum 108, by way of the third drum 110, again in the direction of the center of rotation 140. As a result, the second drum 106 together with its inclined surfaces 220 is likewise moved again in the direction of the center of rotation 140, as a result of which the inclined surfaces 242 of the first drum 108 come to bear against the inclined surfaces 206 of the housing 102 and slide along them while performing another rotation of the first drum 108 into the third position, as is illustrated in FIGS. 4D and 4E.

As a further alternative, a further actuator, not shown here, could also be used instead of the restoring means 114.

As a matter of principle, the actuator 900 can be operated electrically, mechanically and/or on the basis of pressure. Particularly suitable is a piezoelectrically, electrostatically, semi-mechanically/manually or electromagnetically operated actuator 900. "operated" in this case refers to the principle of action the actuator 900 uses to generate the actuation force for actuating the drum 106 (or, depending on embodiment, also one of the drums 108 or 110). By way of example, the actuator 900 can have an electromagnet, which interacts with a metal part which is arranged in one of the drums 106, 108, 110 and attracts or repulses the electromagnet with suitable control of the latter so as to achieve the above-explained displacement of the drums 106, 108, 110 relative to one another. The compressive force applied by the actuator 900 onto the second drum 106 is typically 0.5-100 N. The compressive force to be applied by the actuator decreases in accordance with the acting centrifugal force.

Preferably, a suitable control device (not illustrated) is provided which controls the actuator 900 such that the drums 106, 108, 110 at the desired time each assume the desired position relative to one another. For this purpose, the control device can have a timer and/or an integrated circuit.

According to an exemplary embodiment (not illustrated), only the first drum 108 and the second drum 106 are provided. An actuating member in the form of a shaft is connected on one side to the actuator 900 and on the other side to the first drum 108. The actuator 900, in particular an electric motor, here rotates the shaft and thus the first drum 108 about the central axis 104, as a result of which different chambers 120, 122, 124 are conductively connected to one another, as described above. A ballpoint pen mechanism is not envisaged in this exemplary embodiment. The actuator 900 can further be configured to move the shaft along the central line 104 in order to space apart the first drum 108 from the second drum 106 for rotation purposes and, after the rotation, to press the drums 106, 108 back together, as a result of which a sealing, conducting connection for example between the chamber 120 and the chamber 124 is provided and/or the switch 500 is closed.

Figure 10:
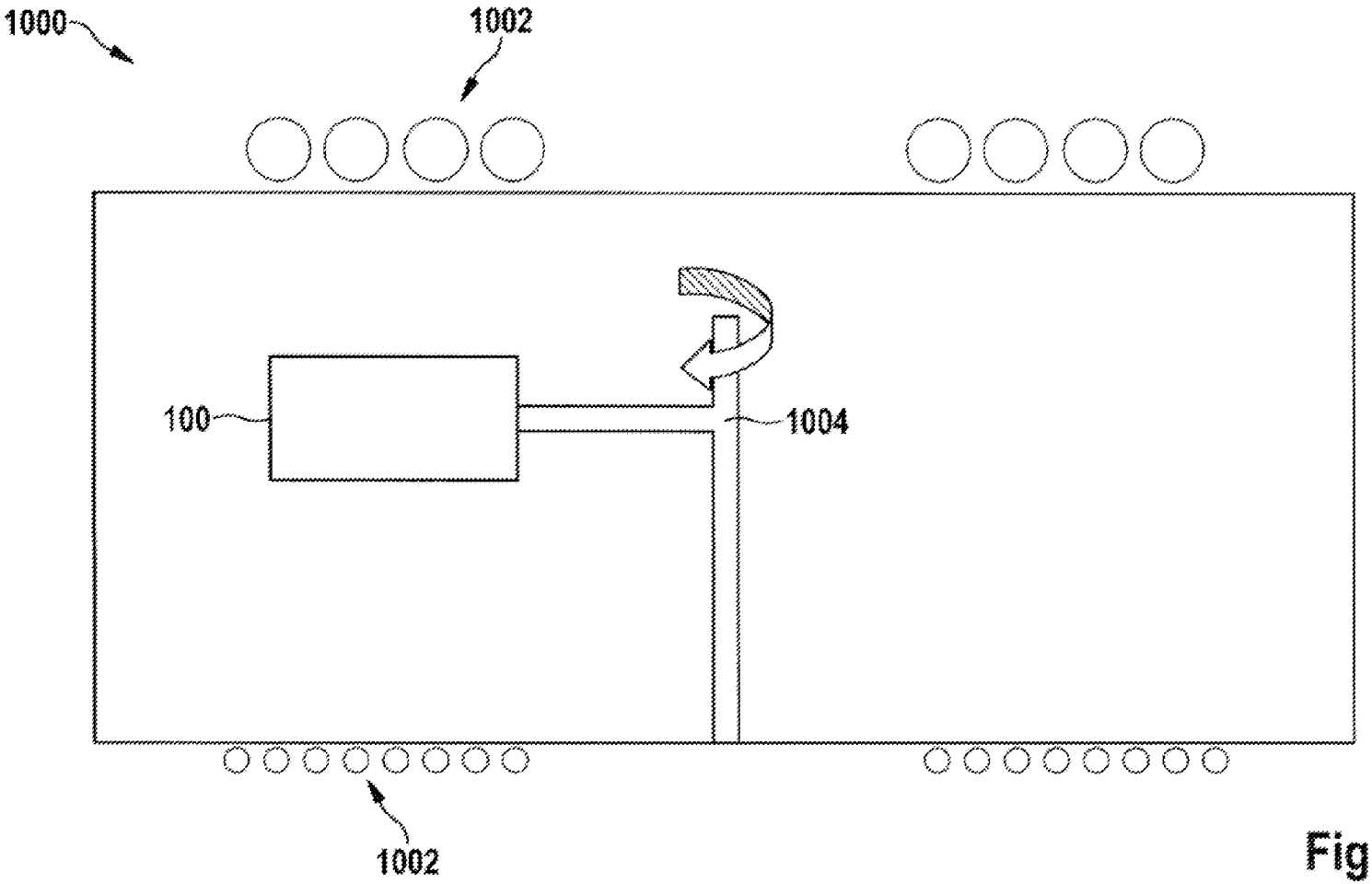
FIG. 10 shows a centrifuge according to an exemplary embodiment of the present disclosure.

FIG. 10 shows in a schematic section a centrifuge 1000 according to an exemplary embodiment of the present disclosure.

The centrifuge 1000 has coils 1002, which can be integrated for example in a cover and/or bottom of the centrifuge. The coils 1002 are used to couple current, for example for operating the heating device 534, into the cartridge 100. For this purpose, the cartridge 100 has one or more coils (not shown). The cartridge 100 is placed into a rotor 1004 of the centrifuge 1000.

Instead of the coils 1002, a battery can also be used, which is arranged in the cartridge 100 and supplies energy for example to the heating device 534.

The energy supply means can be configured as a re-usable structural part or as an appliance which during operation of the cartridge 100 is part thereof. For example, the cover 118 can be provided such that it is removable with an integrated rechargeable battery.

A sensor in the housing 102 of the cartridge 100 can be configured such that it can be removed from the housing 102 after the biochemical processes are carried out and the sensor data can be then be read externally.

In a cartridge 100 with components 536 therein, which are processed under the action of pressure rather than centrifugal forces, the energy supply and control of sensors can be performed using conventional contact-making connections.

According to a further embodiment, measurement signals from the sensors or cartridge 100 can be transmitted to the outside of the cartridge 100 using a transmission device (e.g. using an RFID chip). This permits real-time measurements to be carried out. In yet another embodiment, the centrifuge 1000 can identify using an RFID chip in the cartridge 100 what type of cartridge was inserted and thus automatically use the correct processing protocol (e.g. frequency protocol with acceleration and deceleration ramps, target frequencies and dwell times).

Depending on the type of embodiment, the second drum 106 and/or the third drum 110 can be provided in a spatially fixed manner or moveably with respect to the housing 102. The drums 106, 110 can, for example, be provided to be in each case rotatable about the central axis 104 using a further actuator.

The conductor tracks 514 can, for example, extend in the housing 102 and be brought into contact directly with sensors, which are provided in non-rotatable drums (for example the second drum 106). As a result, simple integration of electrical systems is made possible.

The switch 500 can as a matter of principle be formed in particular between any two drums 106, 108, 110, or between any drum 106, 108, 110 and the housing 102.

Furthermore, the mixing chamber 124 can have an obstacle structure (not shown), such as a sieve or a grating structure, which is configured to move through the component 536 under the action of a centrifugal force (i.e. when the rotational speed of the centrifuge exceeds a predetermined threshold value) in order to mix the component 536 in this way.

The housing 102 and the drums 106, 108, 110 can be produced from the same or different polymers. The one or more polymers are in particular thermoplastics, elastomers or thermoplastic elastomers. Examples are cycloolefin polymer (COP), cycloolefin copolymer (COC), polycarbonates (PC), polyamides (PA), polyurethanes (PU), polypropylene (PP), polyethylene terephthalate (PET) or poly(methyl methacrylate) (PMMA).

The second drum 106 and/or the third drum 110 can be formed to be one piece with the housing 102.

Although the disclosure in the present case was described with reference to preferred exemplary embodiments, it is in no way limited thereto, but rather modifiable in a variety of ways. It is pointed out in particular that the embodiments and exemplary embodiments described here for the cartridges according to the disclosure are applicable correspondingly to the centrifuge according to the disclosure and to the method according to the disclosure, and vice versa. It is furthermore pointed out that "a" does not exclude a multiplicity.

What is claimed is:

1. A cartridge, comprising:

a first drum defining a first chamber;

a displacement device which is configured to rotate the first drum about a central axis of the first drum so as to connect the first chamber to a second chamber defined in the cartridge to enable conduction of at least one of liquids, gases, and particles between the first chamber and the second chamber; and an electric switch configured to be actuated by the displacement device between a closed switching state and an open switching state, the electric switch including a first contact element and a second contact element, the first contact element contacting the second contact element in the closed switching state and the first contact element being spaced apart from the second contact element in the open switching state.

2. The cartridge according to claim 1, further comprising:

a housing in which the first drum, the displacement device, and the electric switch are arranged; and a restoring mechanism configured to bias the displacement device and first drum together, wherein:

the displacement device includes a first inclined surface; and the first drum includes a second inclined surface with which the first inclined surface interacts to move the first drum along the central axis against the biasing of the restoring mechanism from a first position, in which the second inclined surface is form-fittingly engaged with the housing to prevent rotation of the first drum, into a second position, in which the form fit is disengaged and the first drum rotates about the central axis.

3. The cartridge according to claim 1, wherein:

the cartridge defines a third chamber;

the second chamber is positioned in a first direction along the central axis from the first chamber, and the third chamber is positioned in a second opposite direction along the central axis with respect to the first chamber; and the displacement device is configured to selectively connect the first chamber with the second chamber or the third chamber.

4. The cartridge according to claim 1, further comprising:

a second drum defining the second chamber; and a third drum defining a third chamber, wherein the second drum is positioned in a first direction along the central axis from the first drum and the third drum is positioned in a second opposite direction along the central axis from the first drum.

5. The cartridge according to claim 1, wherein:

the first contact element is attached on a front end of the first drum and the second contact element is attached on a front end of a second drum facing the front end of the first drum; or the cartridge includes a housing in which the first drum, the displacement device, and the electric switch are arranged, the first contact element is arranged on the first drum, a second drum, or a third drum and the second contact element is arranged on the housing.

6. The cartridge according to claim 5, wherein the second contact element is arranged on a projection of the housing.

7. The cartridge according to claim 5, wherein the switch includes at least one further contact element, which is configured to be contacted selectively by the second contact element by rotating the first drum.

8. The cartridge according to claim 2, wherein:

the first and second contact elements contact one another in a contact position of the first drum, which follows the second position of the first drum, and in the contact position, the first drum and the housing engage one another and are configured to prevent displacement of the first drum relative to the housing due to the biasing of the restoring mechanism.

9. The cartridge according claim 1, wherein at least one of the first contact element and the second contact element includes at least one of a conductor track and at least one metallic bump.

10. The cartridge according to claim 1, wherein the switch is configured to be connected to a read device, which is configured to one or more of read a switching state of the switch and store a switching profile of the switch.

11. The cartridge according to claim 1, further comprising:

a housing in which the first drum, the displacement device, and the electric switch are arranged; and a heating device provided in or on the housing and is configured for cyclic heating of one or more of the first chamber, the second chamber, and a third chamber, the heating device being operably connected the switch and configured to be activated in the closed configuration of the switch.

12. The cartridge according to claim 1, further comprising:

a housing in which the first drum, the displacement device, and the electric switch are arranged; and a semiconductor device that is provided in or on the housing, the semiconductor device being operably connected to and actuated by the switch.

13. The cartridge according to claim 1, wherein the cartridge is configured to be subjected to a centrifugal force during centrifugation, and wherein:

the displacement device is configured to actuate the first drum for rotation about the central axis when the centrifugal force exceeds a predetermined threshold value, or the displacement device has an actuator configured to actuate the first drum for rotation about the central axis.

14. The cartridge according to claim 1, wherein the switch is connected to an energy source by wires or is connectable in wireless fashion to generate a flow of energy, in the closed state of the switch, through the switch.

15. A centrifuge, comprising:

a rotor; and a cartridge including:

a first drum defining a first chamber;

a displacement device which is configured to rotate the first drum about a central axis of the first drum so as to connect the first chamber to a second chamber defined in the cartridge to enable conduction of at least one of liquids, gases, and particles between the first chamber and the second chamber; and an electric switch configured to be actuated by the displacement device between a closed switching state and an open switching state, the electric switch including a first contact element and a second contact element, the first contact element contacting the second contact element in the closed switching state and the first contact element being spaced apart from the second contact element in the open switching state.

* * * * *